US006814635B1

(12) United States Patent
Okabe

(10) Patent No.: US 6,814,635 B1
(45) Date of Patent: Nov. 9, 2004

(54) VERTICALLY EXTENDABLE ARRANGEMENT FOR MARINE PROPULSION DEVICE

(75) Inventor: Yoshihiko Okabe, Hamamatsu (JP)

(73) Assignee: Yamaha Marine Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/352,391

(22) Filed: Jan. 27, 2003

(30) Foreign Application Priority Data

Jan. 25, 2002 (JP) ..... 2002-016296

(51) Int. Cl.[7] ..... B63H 23/00
(52) U.S. Cl. ..... 440/83; 440/88 P
(58) Field of Search ..... 440/88 P, 83

(56) References Cited

U.S. PATENT DOCUMENTS 2,071,634 A * 2/1937 Irgens ..... 416/25
2,096,457 A * 10/1937 Irgens ..... 440/66
3,051,120 A * 8/1962 Standal ..... 440/53
3,181,495 A * 5/1965 Kiekhaefer ..... 440/88 M
4,600,395 A * 7/1986 Pichl ..... 440/61 R
4,650,428 A * 3/1987 Bland et al. ..... 440/83
4,747,796 A 5/1988 Iwai et al.
4,767,225 A 8/1988 Iio
4,917,639 A 4/1990 Onoue
5,411,423 A * 5/1995 Higby ..... 440/83
6,322,407 B1 11/2001 Onoue

OTHER PUBLICATIONS

Co–pending Application No. 09/606,622, filed Jun. 29, 2000 in the name of Akihiro Onoue, et al.

* cited by examiner

*Primary Examiner*—Sherman Basinger
(74) *Attorney, Agent, or Firm*—Knobbe, Martens, Olson & Bear, LLP

(57) ABSTRACT

An outboard motor has a driveshaft housing and a lower unit coupled with each other. A driveshaft, which extends through the driveshaft housing and the lower unit, is divided into upper and lower section. The upper driveshaft section defines splines on a bottom outer surface. The lower driveshaft section defines splines on a top outer surface. A tubular coupling member defines splines on an inner surface thereof. The coupling member couples the bottom outer surface of the first shaft with the top outer surface of the second shaft by the respective splines. In one arrangement, a water pump is driven by the driveshaft. The coupling member is interposed between a rotor of the water pump and respective portions of the first and second shafts. In another arrangement, a bearing unit journals the driveshaft. The coupling member is interposed between a bearing of the bearing unit and the respective portions of the first and second shafts.

28 Claims, 10 Drawing Sheets

VERTICALLY EXTENDABLE ARRANGEMENT FOR MARINE PROPULSION DEVICE

PRIORITY INFORMATION

This application is based on and claims priority to Japanese Patent Application No. 2002-016296, filed on Jan. 25, 2002, the entire contents of which is hereby expressly incorporated by reference herein.

BACKGROUND OF THE INVENTION

1. Field of the Invention

The present invention generally relates to a vertically extendable arrangement for a marine propulsion device, and more particularly relates to an improved arrangement for a marine propulsion device in which a driveshaft of the propulsion device is vertically extendable so as to be capable of being used in multiple housings of differing lengths.

2. Description of Related Art

Marine propulsion device such as, for example, outboard motors incorporate an engine as a prime mover to power a marine propelling unit. The propelling unit typically is a propeller and is submerged when an associated watercraft rests on a body of water. The engine typically is placed atop the outboard motor. A drive train and a transmission couple the engine with the propelling device. Typically, the engine has a crankshaft that extends generally vertically. The drive train includes a driveshaft below the engine. The driveshaft also extends generally vertically and is connected to the crankshaft to transfer the power of the engine to a propulsion shaft, which also forms a portion of the drive train. The transmission selectively couples the propulsion shaft with the driveshaft.

Typically, the driveshaft for the outboard motors extends within a housing unit. The driveshaft and the housing unit normally have a specific length. The associated watercraft, however, can have various sizes. Thus, the driveshaft and the housing unit can be shorter than a height of the associated watercraft. If the driveshaft and the housing unit are shorter than the height of the watercraft, the propelling unit tends to be placed higher than a desired position on the watercraft. Accordingly, in some applications, both the driveshaft and the housing unit need to be lengthened such that the propelling unit is disposed at a suitable position relative to the watercraft hull.

In order to elongate the length of the driveshaft, for example, the driveshaft can be divided into upper and lower sections and two types of upper section, i.e., regular size and longer size upper sections, can be prepared. Either the regular size or longer size upper section is selected in accordance with the height of the associated watercraft. A housing extension member also is prepared to elongate the housing unit to accommodate the longer size upper section when selected.

FIG. 1 illustrates an exemplary construction defined within a housing unit 20. The housing unit 20 comprises a driveshaft housing 22 and a lower unit 24. A driveshaft 26 is divided into an upper section 28 and a lower section 30. As noted above, two types of the upper section 28 can be provided. In the illustrated arrangement, the upper section 28 has a regular size. No extension housing thus is applied in this arrangement. The upper and lower sections 28, 30 can be coupled with each other through a spline connection. That is, a bottom end of the upper section 28 and a top end of the lower section 30 define key ways. A tubular coupling member 34 also defines key ways on an inner surface thereof. The key ways of the coupling member 34 engage the key ways of the upper and lower sections 28, 30 to complete the spline connection.

Generally, the key ways need to be long enough to ensure a necessary strength of the connection. The driveshaft, however, is journaled by a bearing assembly in the housing unit. Also, the drive shaft drives an auxiliary device such as, for example, a water pump. Thus, it often is difficult to design the coupling member with sufficient length without interfering with auxiliary devices and bearing assemblies.

A need therefore exists for a vertically extendable arrangement for a marine propulsion device that can ensure the strength of the connection between sections of a driveshaft.

SUMMARY OF THE INVENTION

An aspect of the present invention involves a marine propulsion device comprising at least first and second housings and first and second shafts. At least a portion of the first shaft extends through the first housing and at least a portion of the second shaft extends through the second housing. The first shaft drives the second shaft, and one of the shafts drives a rotatable member. The first and second shafts are coupled together by a tubular coupling member. The first shaft includes a plurality of external splines that are disposed at least near one of its ends and the second shaft also including plurality of external splines that are disposed at least near one of its ends. The tubular coupling member defines a plurality of internal splines. The splines of the coupling member engage the splines of the first and second shafts to couple together the first and second shafts. The coupling member is also disposed between the rotatable member and whichever one of the first and second shafts drives the rotatable member.

Another aspect of the present invention involves a marine propulsion device comprising at least first and second housings. The second housing is disposed below the first housing. At least a portion of a first extends generally vertically through the first housing. The first shaft drives a second shaft. At least of portion of the second shaft extends generally vertically through the second housing. Either the first or second shaft defining a recess. The second or first shaft that does not define the recess defines a tip portion that is inserted into the recess. The recess defines a first plurality of key ways on an inner surface thereof and the tip portion defines a second plurality of key ways on an outer surface thereof. The respective first and second key ways are engaged with one another to couple together the first and second shafts.

In accordance with an additional aspect of the invention, a marine propulsion device is provided that comprises a prime mover having an output shaft, which extends generally vertically, and first, second and third housings. The second housing is disposed below the first housing, and the third housing is disposed below the second housing. A first shaft is driven by the output shaft. At least a portion of the first shaft extends generally vertically within the first housing, and the first shaft drives a second shaft. At least a portion of the second shaft extends generally vertically through the first, second and third housings. The output shaft and the first shaft are coupled together by a first spline coupling, and the first and second shafts are coupled together by a second spline coupling.

In accordance with an additional aspect of the present invention, a marine propulsion device comprises at least first and second housings. The second housing is disposed below the first housing. A first shaft is provided. At least a portion of the first shaft extends generally vertically through the first housing. A second shaft is driven by the first shaft. At least a portion of the second shaft extends generally vertically through the second housing. A pump unit is driven by either the first or second shaft. The pump unit comprises a pump housing surrounding the first or second shaft. The first and second shafts are coupled with each other within the pump housing.

In accordance with another aspect of the present invention, a marine propulsion device comprises at least first and second housings. The second housing is disposed below the first housing. A first shaft is provided and at least a portion of the first shaft extends generally vertically through the first housing. A second shaft is driven by the first shaft. At least a portion of the second shaft extends generally vertically through the second housing. A coupling member joins the first and second shafts together, and a bearing unit journals the coupling member within one of the housings.

BRIEF DESCRIPTION OF THE DRAWINGS

These and other features, aspects and advantages of the present invention are described below with reference to the drawings of preferred embodiments, which are shown in FIGS. 2 through 10 and which are intended to illustrate and not to limit the invention. In particular.

FIG. 5 is an enlarged side view of a connection between sections of the driveshaft.

FIG. 6 is an enlarged side view of a modified connection between sections of the driveshaft configured in accordance with another preferred embodiment.

FIG. 7 is an enlarged side view of a further modified connection between sections of the driveshaft configured in accordance with an additional preferred embodiment.

FIG. 8 is an enlarged side view of a still further modified connection between sections of the driveshaft configured in accordance with yet another preferred embodiment.

FIG. 9 is an enlarged side view of a yet further modified connection between sections of the driveshaft configured in accordance with an additional preferred embodiment.

FIG. 10 is an enlarged side view of a further modified connection between sections of the driveshaft configured in accordance with yet another preferred embodiment.

DETAILED DESCRIPTION OF THE PREFERRED EMBODIMENTS

Figure 1:
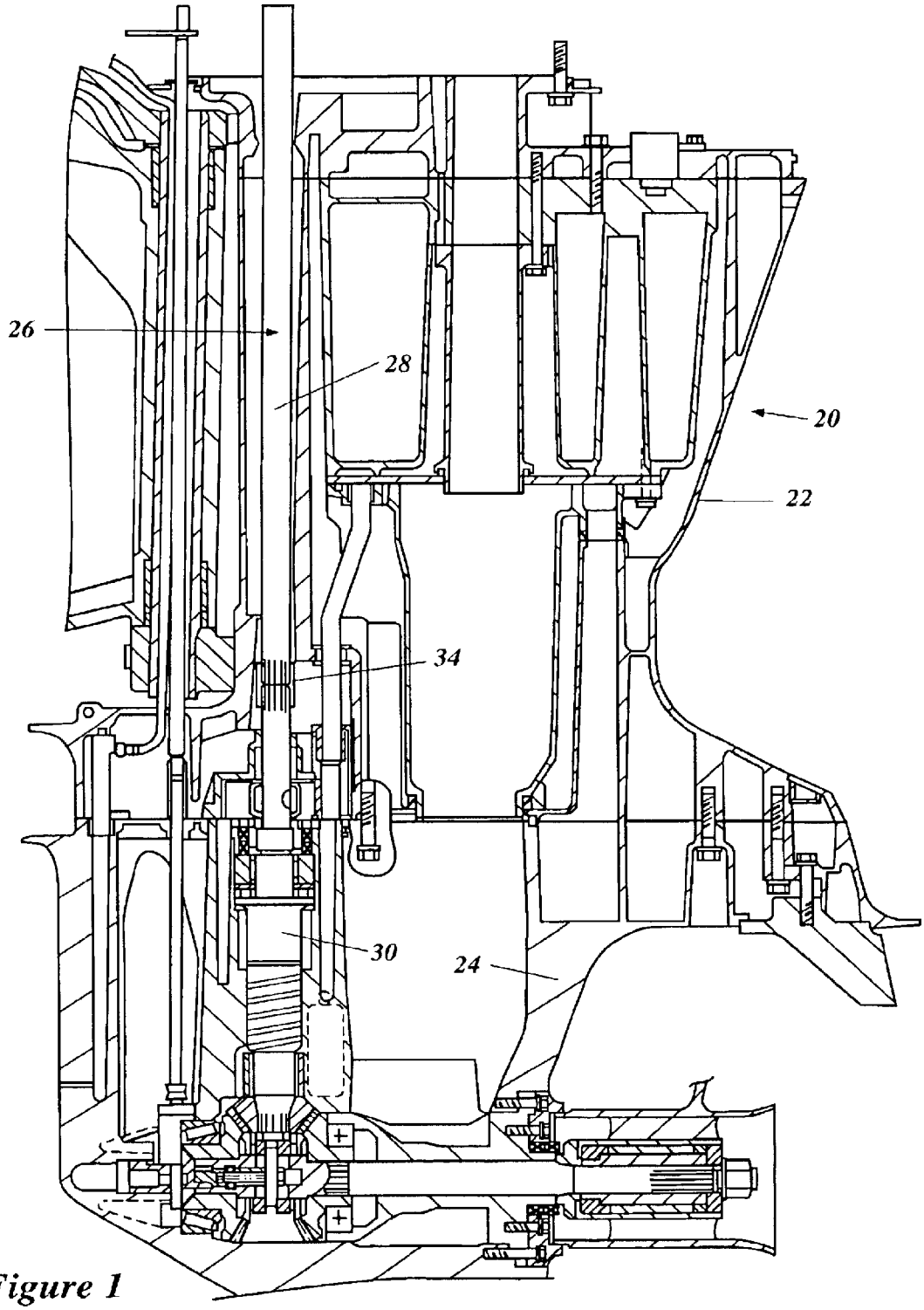
Figure 1 Prior Art
FIG. 1, as noted above, is a cross-sectional side view of a portion of an outboard motor showing an exemplary construction in a housing unit of the outboard motor. As discussed above, the figure is provided to illustrate a problem in connection with an extendable arrangement for an outboard motor.
Figure 2:
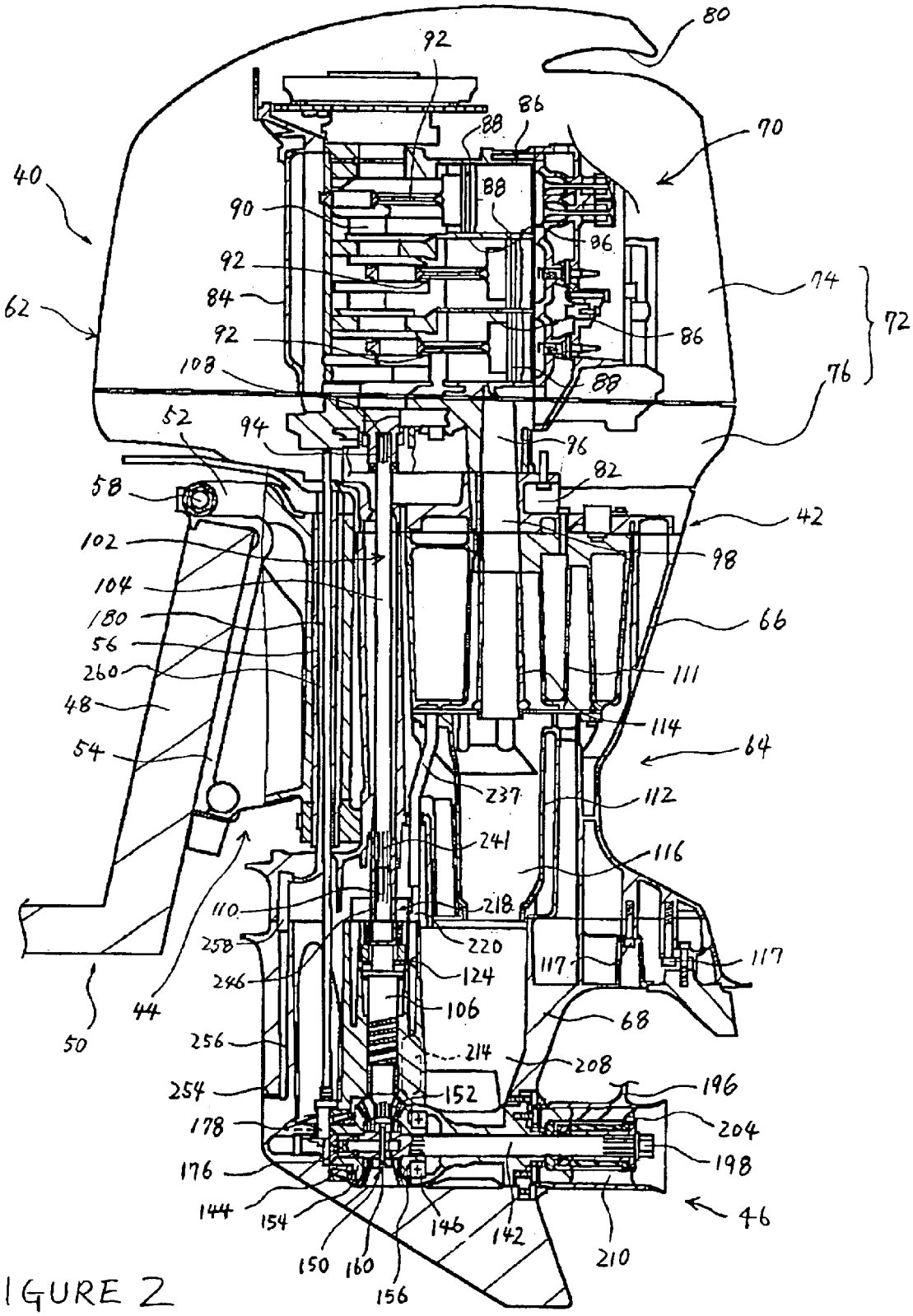
FIG. 2 is a cross-sectional side view of an outboard motor configured in accordance with a preferred embodiment of the present invention. Although a power head of the outboard motor is not sectioned in this figure, an engine of the power head is schematically illustrated as visible. A portion of an associated watercraft also is shown in the figure.
Figure 3:
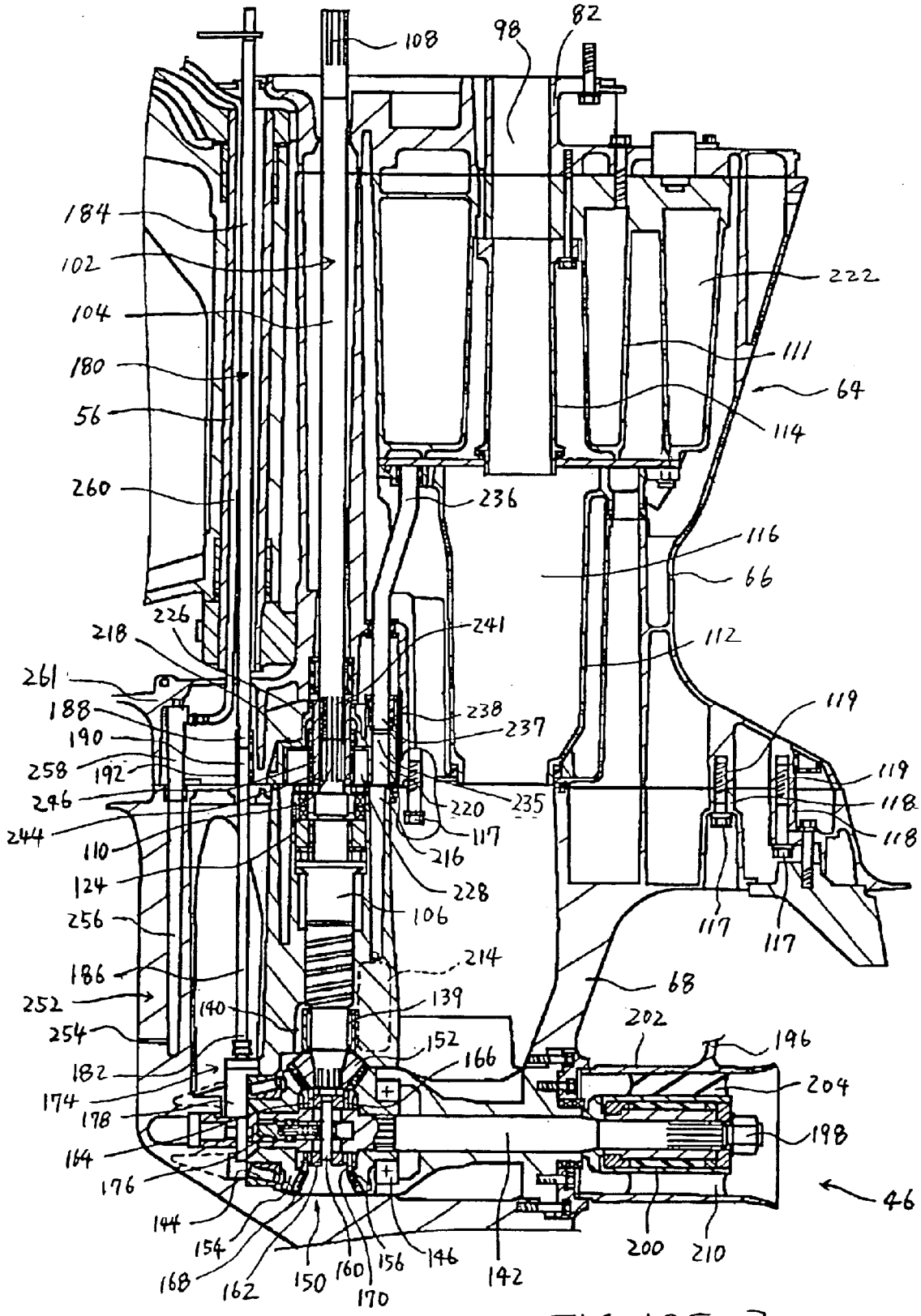
FIG. 3 is a cross-sectional side view of a portion of the outboard motor illustrated in FIG. 2, showing a construction in a housing unit of the outboard motor where a regular size driveshaft section is applied.
Figure 5:
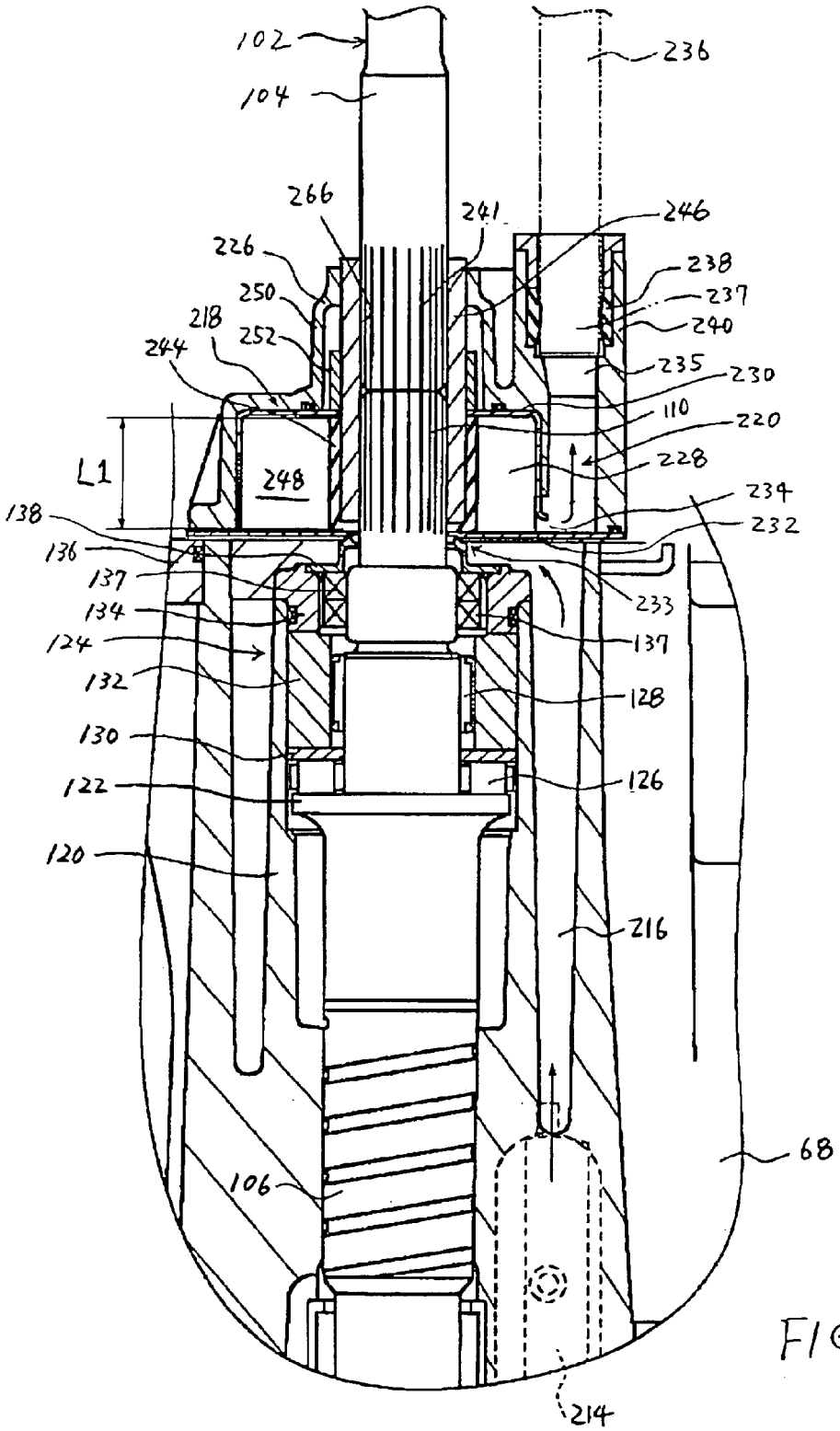
FIGS. 5 through 10 illustrate several variations of a coupling between sections of a driveshaft. To clarify the similarities between these embodiments, like components of the embodiments have been assigned the same reference numerals in the drawings, and the initial description of such components below will also apply to all later described embodiments, unless indicated otherwise. Each of the ten figure will now be briefly described.

With reference to FIGS. 2, 3 and 5, an overall construction of an outboard motor 40 configured in accordance with certain features, aspects and advantages of the present invention is described below. The outboard motor merely exemplifies one type of marine propulsion device on which various aspects and features of the present invention can be suitably used. Other types of marine propulsion devices such as, for example, outboard drives and stern drives for inboard/outboard systems can employ various features, aspects and advantages of the present invention. Such marine propulsion devices will be apparent to those of ordinary skill in the art in view of the description herein.

With particular reference to FIG. 2, the outboard motor 40 generally comprises a drive unit 42, a bracket assembly 44, and a propelling unit 46. The bracket assembly 44 supports the drive unit 42 on a transom 48 of an associated watercraft 50 and places the propelling unit 46 in a submerged position when the watercraft 50 rests on a surface of a body of water. The bracket assembly 44 preferably comprises a swivel bracket 52, a clamping bracket 54, a tubular steering shaft 56 and a pivot pin 58.

The steering shaft 56 extends through the swivel bracket 52 and is affixed to the drive unit 42. The steering shaft 56 is pivotally journaled for steering movement about a generally vertically extending steering axis defined within the swivel bracket 52. The clamping bracket 54 comprises a pair of bracket arms that are spaced apart from each other and that are affixed to the watercraft transom 48. The pivot pin 58 completes a hinge coupling between the swivel bracket 52 and the clamping bracket 54. The pivot pin 58 extends through the bracket arms so that the clamping bracket 54 supports the swivel bracket 52 for pivotal movement about a generally horizontally extending tilt axis defined by the pivot pin 58. The drive unit 42 thus can be tilted or trimmed about the pivot pin 58.

As used through this description, the terms "forward," "forwardly" and "front" mean at or toward the side where the bracket assembly 44 is located, and the terms "rear," "reverse," "backward" and "rearward" mean at or toward the opposite side of the front side, unless indicated otherwise or otherwise readily apparent from the context use.

A hydraulic tilt and trim adjustment system preferably is provided between the swivel bracket 52 and the clamping bracket 54 for tilt movement (raising or lowering) of the swivel bracket 52 and the drive unit 42 relative to the clamping bracket 54. Otherwise, the outboard motor 40 can have a manually operated system for tilting the drive unit 42. Typically, the term "tilt movement," when used in a broad sense, comprises both a tilt movement and a trim adjustment movement.

The illustrated drive unit 42 comprises a power head 62 and a housing unit 64. The housing unit 64 comprises a drive housing or first housing 66 and a lower unit or second housing 68.

The power head 62 is disposed atop the drive unit 42 and includes an internal combustion engine 70 and a protective cowling assembly 72 surrounding the engine 70. The engine 70 preferably is a water-cooled, four-cycle engine. This type of engine, however, merely exemplifies one type of engine and other types of engine can be applied (e.g., a two cycle engine). The protective cowling assembly 72 preferably comprises top and bottom cowling members 74, 76 that are detachably coupled with each other.

The top cowling member 74 preferably has a rear intake opening 80 on its rear and top portion. Ambient air thus is drawn into a closed cavity defined by the cowling assembly 72 through the rear intake opening 80.

The bottom cowling member 76 preferably has an opening through which an upper portion of an engine support member 82 extends. The support member 82 preferably is affixed atop the driveshaft housing 66. The bottom cowling member 76 and the support member 82 together generally form a tray. The engine 70 is placed onto this tray and is affixed to the support member 82. The illustrated support member 82 can define the first housing together with the driveshaft housing 66 in some arrangements.

The engine 70 has an engine body 84 that defines three cylinder bores 86 spaced apart vertically from one another. A piston 88 is reciprocally disposed in each cylinder bore 86. The pistons 88 define three combustion chambers together with the cylinder bores 86. A crankshaft 90, which is an output shaft of the engine 70 in the illustrated embodiment, extends generally vertically through the engine body 84. The crankshaft 90 is rotatably connected to the respective pistons 88 through connecting rods 92 and rotates with the reciprocal movement of the pistons 88. A bottom end of the crankshaft 90 defines a recess 94. Key ways (i.e., spaces between keys or splines) are defined on an inner surface of the recess 94.

The pistons 88 reciprocate within cylinder bores 86 when air/fuel charges are burnt in the combustion chambers. The air and the fuel are supplied to the combustion chambers through an air intake system and a fuel supply system, respectively. Preferably, the air in the closed cavity of the protective cowling assembly 72 is drawn into the combustion chambers through the air intake system. The fuel supply system can include a direct or indirect fuel injection device. The fuel supply system alternatively can include one or more carburetors.

An exhaust system is provided to route the burnt charges (e.g., exhaust gases) from the combustion chambers to an external location. The engine body 84 defines an exhaust manifold 96 that collects the exhaust gases from the combustion chambers. The support member 82 also defines an exhaust passage 98 through which the exhaust gases move to the driveshaft housing 66.

With reference to FIGS. 2 and 3, the driveshaft housing 66 is disposed below the power head 62 and the lower unit 68 depends from the driveshaft housing 66. A driveshaft 102 extends generally vertically through the driveshaft housing 66 and the lower unit 68. The illustrated driveshaft 102 is divided into first and second sections. In the illustrated embodiment, the driveshaft 102 includes an upper section 104 and a lower section 106.

The upper section 104 generally extends through the support member 82 and the driveshaft housing 66. A top end 108 of the upper section 104 is inserted into the recess 94 of the crankshaft 90. The top end 108 forms key ways that can engage the key ways of the recess 94. The driveshaft 102 thus is coupled with the crankshaft 90 at the top end 108 of the upper section 104 through a spline connection (i.e., a connection formed by interengaged keys or splines for transferring a rotational force).

The lower section 106 generally extends through the lower unit 68 and a top end portion 110 of the lower section 106 is engageable from the top side of the lower unit 68. In the illustrated embodiment the top end portion 110 extends beyond a top surface of the lower unit 68 toward the driveshaft housing 66. The upper and lower sections 104, 106 are coupled with each other through a spline connection, which will be described greater detail below.

The driveshaft 102 thus is driven by the crankshaft 90 and rotates as a single shaft through both of the spline connections.

The driveshaft housing 66 preferably defines upper and lower internal sections 111, 112. The upper internal section 111 incorporates an exhaust pipe 114 extending downwardly to define an exhaust passage that receives the majority of exhaust gases from the exhaust passage 98 of the support member 82. The lower internal section 112 defines an expansion chamber 116 below the exhaust pipe 114. The expansion chamber 116 receives the exhaust gases from the exhaust pipe 114 and guides the exhaust gases to the lower unit 68. Because the exhaust gases expand in the expansion chamber 116, the exhaust noise is reduced within the expansion chamber 116. The upper internal section 111 also defines an idle discharge passage branched off from the exhaust passage 98. The discharge passage discharges idle exhaust gases directly to the atmosphere through a discharge port. The discharge port is formed at the rear of the driveshaft housing 66.

The lower unit 68 preferably is affixed to the bottom end of the driveshaft housing 66. In the illustrated arrangement, bolts 117 connect boss portions 118 of the lower unit 68 with boss portions 119 of the driveshaft housing 66.

The lower unit 68 journals the lower section 106 of the driveshaft 102. With particular reference to FIG. 5, the lower unit 68 forms an inner tubular portion 120 that extends upwardly and surrounds the lower driveshaft section 106. A generally lower half portion of the lower driveshaft section 106 has a larger diameter than an upper half portion thereof. A flange 122 is formed at a top end of the large diameter portion. In the illustrated arrangement, a bearing unit 124 journals a portion of the lower section 106 located above the flange 122.

The bearing unit 124 preferably comprises a thrust bearing 126, a radial or needle bearing 128, an intermediate member 130, a ring member 132 and a backing member 134. The thrust bearing 126 is positioned just above the flange 122 of the lower driveshaft section 106. An upward movement of the lower section 106 is received by the thrust bearing 126 and finally by the lower unit 68 via the intermediate member 130, the ring member 132, the backing member 134 and a cover member 136. The radial bearing 128 supports the lower driveshaft section 106 in the radial direction. The inner tubular portion 120 supports the radial bearing 128 via the ring member 132.

Seal members 137 preferably seal the bearing unit 124. The illustrated seal members 137 are positioned around a portion of the lower section 106 surrounded by the backing member 134 and are interposed between the portion of the lower section 106 and the backing member 134.

The illustrated cover member 136 is affixed to the top end of the lower unit 68 to confine the bearing unit 124 and the seal members 137 in the lower unit 68 and to receive the upward movement of the lower driveshaft section 106 as discussed above. In the illustrated arrangement, an isolating member 138 is employed to isolate the seal members 137 from the water supply passage 216.

With reference to FIG. 3, a bottom portion of the lower driveshaft section 106 preferably is supported by a radial bearing 139 disposed at a bearing portion 140 of the lower unit 68.

With reference to FIGS. 2 and 3, the lower unit 68 also journals a propulsion shaft 142. More specifically, in the illustrated arrangement, bearings 144, 146 journals the propulsion shaft 142 within the lower unit 68. The propulsion shaft 142 extends generally horizontally through the lower unit 68 and lies generally normal to the driveshaft 102 (i.e., at a 90° shaft angle).

The propulsion shaft 142 is coupled with the driveshaft 102 through a transmission and is driven by the driveshaft 102. The transmission preferably comprises a bevel gear coupling and a dog clutch mechanism 150. The bevel gear coupling includes a pinion gear 152 placed at a bottom end of the lower driveshaft section 106, a forward gear 154 placed on the propulsion shaft 142 in front of the pinion gear 152 and a reverse gear 156 placed on the propulsion shaft 142 on the rear side of the pinion gear 152. The forward and reverse gears 154, 156 mesh with the pinion gear 152 so as to always rotate inasmuch as the driveshaft 102 rotates and to rotates about the propulsion shaft 142 if not engaged thereto by the dog clutch mechanism 150. The dog clutch mechanism 150 can selectively connect either the forward or reverse gear 154, 156 with the propulsion shaft 142.

The illustrated dog clutch mechanism 150 comprises a clutch pin 160 penetrating the propulsion shaft 142 and a clutch member 162 defining forward and reverse dog teeth 164, 166. The forward and reverse gears 154, 156 also define forward and reverse dog teeth 168, 170, respectively. The forward and reverse dog teeth 168, 170 can engage the forward and reverse dog teeth 164, 166, respectively.

When the clutch member 162 moves toward the forward gear 154, the forward dog teeth 164 of the clutch member 162 engage the forward dog teeth 168 of the forward gear 154 and then the propulsion shaft 142 rotates in one direction through a spline connection between the clutch member 162 and the shaft 142. When the clutch member 162 moves toward the reverse gear 156, the reverse dog teeth 166 of the clutch member 162 engage the reverse dog teeth 170 of the reverse gear 156 and then the propulsion shaft 142 rotates in another direction through the spline connection. If the clutch member 162 stays in a mid position between the forward and reverse gears 154, 156, none of the dog clutch connections is made and the propulsion shaft 142 does not rotates. That is, the transmission can take either one of the forward, reverse and neutral positions corresponding to the two rotational directions and non-rotational state of the propulsion shaft 142.

A shift actuating mechanism 174 actuates the clutch mechanism 150. The shift actuating mechanism 174 comprises a slider 176, a shift actuator 178, a shift rod 180 and a shift cable. The slider 176 is slidably disposed within the propulsion shaft 142 and is coupled with the clutch pin 160. A bias spring preferably is positioned in the slider 176 for biasing the clutch pin 160 toward the mid position, i.e., the neutral position. The shift actuator 178 is coupled with the slider 176 through a cam connection. That is, the shift actuator 178 has a cam and the slider 176 has a cam follower such that the slider slides in the propulsion shaft 142 with the shift actuator 178 rotating.

The shift rod 180 is coupled with a top portion of the shift actuator 178 at a bottom end 182 and extends generally vertically through the lower unit 68 and the steering shaft 56 from the shift actuator 178. The shift rod 180 is rotatable together with the shift actuator 178 relative to the housing unit 64. The shift cable preferably is coupled with a top portion of the shift rod 180 to rotate the shift rod 180 in a space defined by the bottom cowling member 76 through a coupling mechanism. The shift cable extends forwardly through an opening defined at a forward portion of the bottom cowling member 76 toward a cockpit of the associated watercraft 50 and is connected to a shift controller such as, for example, a shift lever. The operator thus can operate the shift actuating mechanism 174 through the shift controller or other control mechanisms.

When the operator operates the shift controller, the shift actuator 178 rotates together with the shift rod 180. The slider 176 thus is moved through the cam connection and slides within the propulsion shaft 142 to bring the clutch mechanism 150 to either the forward or reverse position.

The shift rod 180 in this arrangement is divided into upper and lower sections 184, 186. A bottom end 188 of the upper section 184 and a top end 190 of the lower section preferably are coupled with each other by a tubular coupling member 192 through a spline connection.

The propelling unit 46 is mounted to the propulsion shaft 142 to rotate with the propulsion shaft 142. In the illustrated arrangement, the propelling unit 46 includes a propeller 196 that is affixed to an outer end of the propulsion shaft 142 by a nut 198. The propulsion device, however, can take the form of a dual counter-rotating system, a hydrodynamic jet, or any of a number of other suitable propulsion devices. The illustrated propeller 196 has a concentric boss configuration. An inner boss 200 is coupled with the propulsion shaft 142 through a spline connection. At least two, preferably three, vanes or blades extends from an outer boss 202. The inner and outer bosses 200, 202 are coupled with each other by rubber dampers 204.

The lower unit 68 also defines a portion of the exhaust system that is connected with the lower internal section 112 of the driveshaft housing 66, i.e., the expansion chamber 116. In the illustrated arrangement, the portion of the exhaust system includes a relatively large exhaust passage or second expansion chamber 208. The illustrated propeller 196 defines discharge passages 210 between the respective rubber dampers 204. The discharge passages 210 communicate with the exhaust passage 208 of the lower unit 68 and open to the body of water surrounding the outboard motor 40 when the propeller 106 is submerged. At engine speeds above idle, the exhaust gases are discharged to the body of water through the exhaust pipe 114, the expansion chamber 116, the exhaust passage 208 and discharge passages 210.

With reference to FIGS. 2, 3 and 5, the outboard motor 40 is provided with a cooling water delivery system to cool the engine 70 and the exhaust. The water delivery system preferably is an open-loop type system that introduces water from the body of water, delivers the water to the engine 70 and the exhaust system and then discharges the water to the outside location; however, other paths of coolant through the engine and exhaust system are also practicable.

The cooling water delivery system preferably comprises a water inlet 214, a water supply passage 216, a water pump 218 and a water delivery passage 220. The water inlet 214 is defined at either or both sides of the lower unit 68 to introduce the cooling water from the body of water. The water supply passage 216 is defined within the lower unit 68 to supply the water to the water pump 218. The water pump 218 preferably is driven by the driveshaft 102. In the illustrated arrangement, the water pump 218 is positioned around the driveshaft 102 at the bottom end of the driveshaft housing 66. A coupling construction of the water pump 218 with the driveshaft 102 will be described in greater detail below. The water delivery passage 220 is defined within the driveshaft housing 66 to deliver the cooling water to water jackets in the engine body 84 and the exhaust system or one or more water pools that surround a portion of the exhaust system such as, for example, the exhaust pipe 114.

Additionally, the illustrated upper internal casing 111 also defines a lubricant oil reservoir 222 around the exhaust pipe 114. The cooling water delivery system can delivery water for cooling the lubricant oil reservoir 222. Preferably, the water pool surrounding the exhaust pipe 114 also cools the lubricant oil reservoir.

With particular reference to FIG. 5, the water pump 50 preferably comprises a pump housing 226 and a rotor 228. The illustrated pump housing 226 defines a recess therein and an inverted cup-like member 230 is inserted within the recess. The rotor 228 is rotatably disposed in the cup-like member 230.

A lower end of the pump housing 226 is covered with a bottom plate 232. The pump housing 226 preferably is affixed to the top end of the lower unit 68 via the bottom plate 232. An inlet 233 is formed on the bottom plate 232 to communicate with the water supply passage 216. An outlet 234 is formed in the cup-like member 230 to communicate with the water delivery passage 220. The water delivery passage 220 starts at a passage portion 235 of the pump housing 218. A water conduit 236 extending from the passage portion 235 to form a further portion of the water delivery passage 220. A bottom end 237 of the water conduit 236 is coupled with the pump housing 218 via a seal member 238 at a protruding portion 240 of the pump housing 218.

The rotor 228 has a plurality of vanes. The vanes radially extends in the cup-like member 230 from a boss 244 of the rotor 228. The vanes and the boss 244 are made of a hard rubber material. The rotor 228 has a height L1 as indicated in FIG. 5. The boss 244 preferably is fixed to a coupling member 246 in a baking process. Thus, the rotor 228 and the coupling member 246 are firmly fixed with each other. The vanes define pumping chambers 248 together with the pump housing 226 and the bottom plate 232.

When the rotor 228 rotates in the pump housing 226, the cooling water is introduced through the water inlet 214 from the body of water and is drawn to the water pump 218 through the water supply passage 216. The water enters the respective pumping chambers 248 when the water supply passage 216 communicates with the pumping chambers through the inlet 233. The water pump 218 pressurizes and delivers the water to the water deliver passage 220 through the outlet 234 when the pumping chambers 248 communicate with the water delivery passage 220. The pressurized water then goes to the water jackets of the engine body 84, the water jackets of the exhaust system, and/or the water pools surrounding the exhaust system and lubricant reservoir (e.g., oil pan). At least a portion of the water that has cooled the engine body 84 and/or the exhaust system can be introduced into the exhaust system within the housing unit 64 and discharged with the exhaust gases.

With reference to FIGS. 2 and 3, the outboard motor 40 preferably is provided with a velocity sensing system 252. The illustrated velocity sensing system 252 senses water pressure at a front surface of the housing unit 64. The velocity sensing system 252 comprises a water pressure inlet port 254, a water pressure conveying passage 256, a water pressure relay member 258, a water pressure conveying conduit 260 and a water pressure sensor (not shown).

The water pressure inlet port 254 is formed on the front surface of the lower unit 68 at a location slightly above a level corresponding to an upper side of the outer propeller boss 202. The water pressure conveying passage 256 is defined at least in part by a front wall of the lower unit 68 so as to communicate with the water pressure inlet port 254. The water pressure conveying passage 256 extends generally upwardly to a forward bottom portion 261 of the driveshaft housing 66. The forward bottom portion 261 defines a recess that has a configuration corresponding to a top outer surface of the water pressure relay member 258. The water pressure relay member 258 is fitted into the recess of the forward bottom portion 261. The water pressure conveying passage 256 is connected to a bottom end of the water pressure relay member 258. The water pressure conveying conduit 260 is joined to a top portion of the water pressure relay member 258 and extends upwardly within the steering shaft 56 along with the shift rod 184. The water pressure conveying conduit 260 then extends to the water pressure sensor from the top end of the steering shaft 56. The water pressure conveying conduit 260 preferably is flexible and is longer than a distance between the relay member 258 and the pressure sensor. The channel from the inlet port 254 to the pressure sensor defines a Pitot tube. The water pressure sensor normally is positioned in the cockpit and indicates the watercraft's velocity. The operator thus can read the velocity of the watercraft 50, which advances in the same speed as the outboard motor 40, by the indication of the water pressure sensor.

With reference to FIG. 5, a coupling construction of the upper and lower driveshaft sections 104, 106 will now be described in greater detail below.

The coupling member 246 is a tubular member and has a length longer than the height L1 of the rotor 228. In the illustrated arrangement, the length of the coupling member 246 is generally twice as long as the height of the rotor 228. Preferably, a portion of the coupling member 246 beyond the height of the rotor 228 generally is enclosed in an enlarged portion 250 of the pump housing 226. A ring member 252 preferably supports the portion of the coupling member 246 beyond the height of the rotor 228.

A bottom portion 264 of the upper driveshaft section 104 defines a plurality of key ways on the outer surface thereof. Similarly, the top end portion 110 of the lower driveshaft section 106 defines a plurality of key ways on the outer surface thereof. The coupling member 246, on the other hand, defines a plurality of key ways on the inner surface 266 thereof.

With this construction, the coupling member 246 is first coupled with the top end portion 110 of the lower driveshaft section 106 with the key ways engaged. Then, the bottom end portion 241 of the upper driveshaft section 104 is inserted into the coupling member 246 with the key ways engaging. The spline connection accordingly is completed and the lower driveshaft section 106 can unitarily rotate with the upper driveshaft section 104.

Both the driveshaft 102 and the housing unit 64 described above are a regular size that can fit on a relatively small size watercraft.

Figure 4:
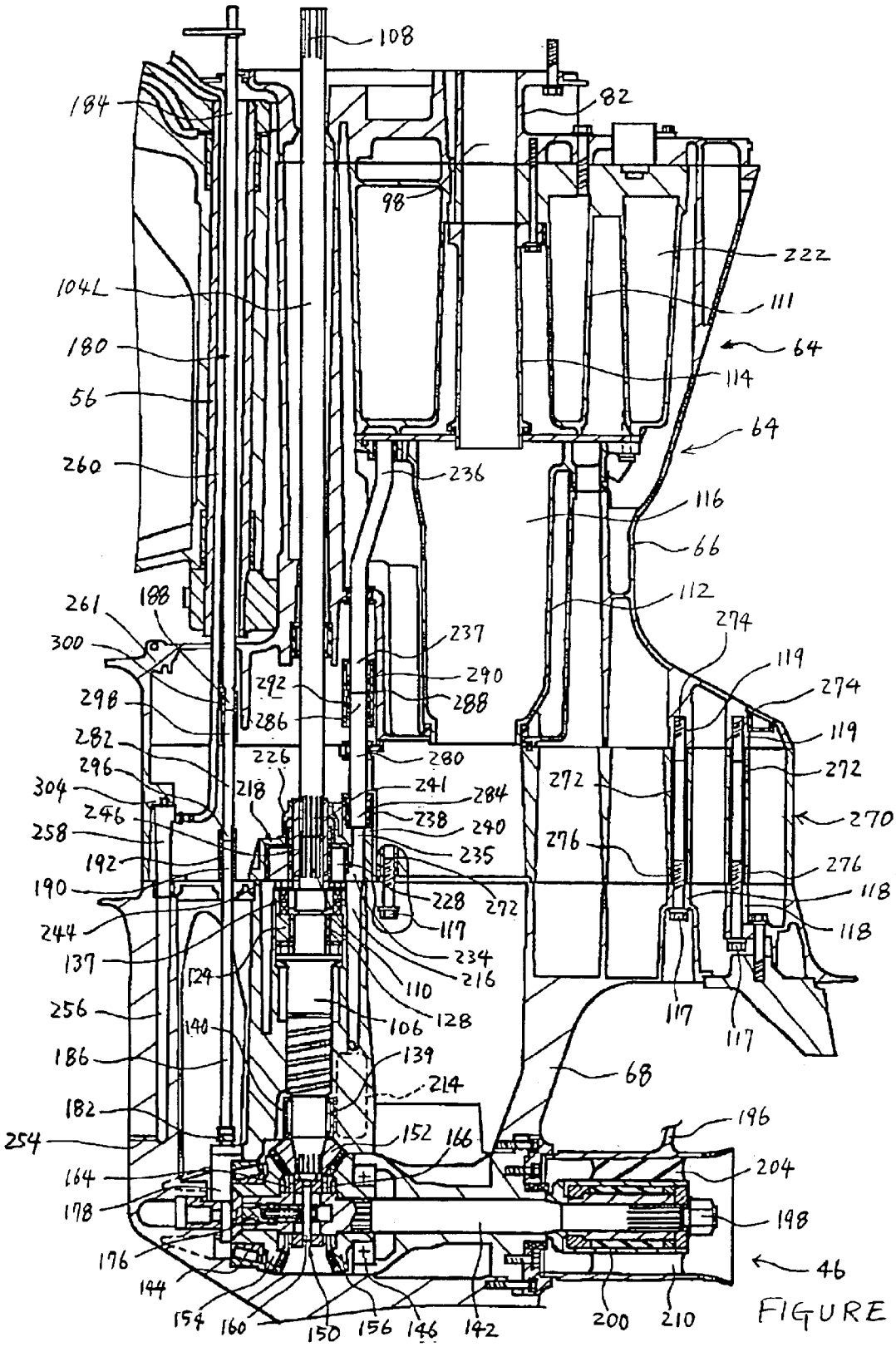
FIG. 4 is a cross-sectional side view of a portion of the outboard motor illustrated in FIG. 2, showing a construction in an elongated housing unit of the outboard motor where a longer size driveshaft section is applied.

With reference to FIG. 4, if the outboard motor 40 is going to be mounted on a relatively large size watercraft and needs to be longer than the regular size, a housing extension member 270 is interposed between the driveshaft housing 66 and the lower unit 68. A plurality of connectors 272 are previously prepared corresponding to the boss portions 118 of the lower unit 68 and the boss portions 119 of the driveshaft housing 66. A stud bolt 274 is affixed to one end of each connector 272 and extends outwardly. Also, a bolt hole 276 is formed at another end of each connector 272. The stud bolts 274 are affixed to the boss portions 119 of the driveshaft housing 66. The bolts 117 are affixed to the bolt holes 276 by the connectors 272 through the boss portions 118 of the lower unit 68. Thus, the extension member 270 is coupled with both the driveshaft housing 66 and the lower unit 68 and is interposed therebetween.

In order to complete the elongated construction, the upper driveshaft section 104 is changed to a longer one and further a conduit extension member 280 and a rod extension member 282 are added.

A longer upper driveshaft section 104L simply replaces the regular size driveshaft section 104. Coupling constructions of the longer driveshaft section 104L to the crankshaft 90 and the lower driveshaft section 106 are the same as those described above in connection with the regular size upper driveshaft section 104.

A bottom end 284 of the conduit extension member 280 is fitted into the protruding portion 240 of the pump housing 226 via the seal member 238. A top end 286 of the conduit extension member 280 meets the bottom end 237 of the water conduit 236. A tubular coupling member 288 preferably encloses both the top end 286 of the conduit extension member 280 and the bottom end 237 of the water conduit 236 to couple the conduit extension member 280 with the water conduit 236. Preferably, a seal member 290 is interposed between the water conduit 236 and the coupling member 288, while a seal member 292 is interposed between the conduit extension member 280 and the coupling member 288.

A bottom end 296 of the rod extension member 282 meets the top end 190 of the lower section 186 of the shift rod 180 and is coupled with the top end 190 by the coupling member 192 through a spline connection. A top end 298 of the rod extension member 282 meets the bottom end 188 of the upper section 184 of the shift rod 180 and is coupled with the bottom end 188 by a tubular coupling member 300 through a spline connection.

The housing extension member 270 defines a projection 304 on an inner front surface. The projection 304 has a recess which configuration is similar to the recess of the forward bottom portion 261 of the driveshaft housing 66. The water pressure relay member 258 thus is fitted into recess of the projection 304. Because the water pressure conveying conduit 260 has a sufficient length and flexibility, no extension member is necessary and the pressure conveying conduit 260 can be simply pulled to be connected to the water pressure relay member 258.

Thus, the housing unit 64 is elongated and the necessary connections between the driveshaft housing 66 and the lower unit 68 are completed within the housing extension member 270. As thus described, in the illustrated arrangement, the upper and lower driveshaft sections 104, 106 are coupled together by a relatively long coupling member 246 because the coupling member 246 also acts as a coupling member of the water pump rotor 228 with the driveshaft 102 and does not interfere with the construction of the water pump 218. The illustrated arrangement increases the strength of connection of the upper and lower driveshaft sections 104, 106.

Figure 6:
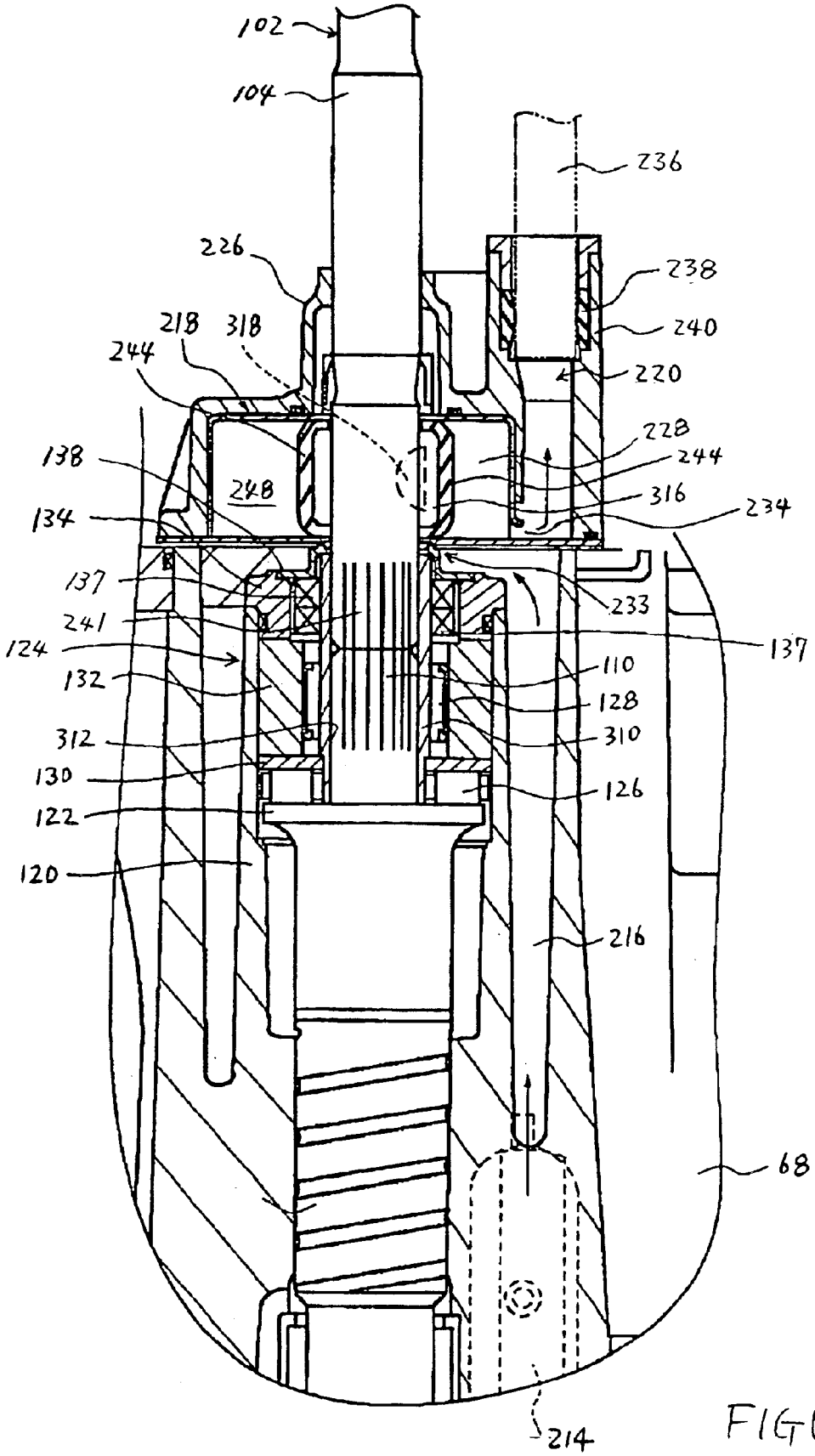

With reference to FIG. 6, a modified arrangement will now be described. In this modified arrangement, the upper and lower driveshaft sections 104, 106 are coupled with each other in the bearing unit 124. A tubular coupling member 310 is employed to couple the driveshaft sections 104, 106. The coupling member 310 preferably has a length enough to separate the thrust bearing 126, the radial bearing 128 and the seal members 137 from the upper and lower driveshaft sections 104, 106. The illustrated radial bearing 128 is a needle bearing. An inner surface 312 of the coupling member 310 defines a plurality of key ways.

The top end 110 of the lower driveshaft section 106 extends upwardly in the inner tubular section 120 of the lower unit 68. The coupling member 310 is first joined with the top end 110 of the lower driveshaft section 106 through the spline connection therebetween. The bottom end 241 of the upper driveshaft section 104 then is inserted into the coupling member 310 and is joined with the coupling member 310 through the spline connection therebetween. The thrust bearing 126, the intermediate member 130, the ring member 132, the seal members 137 and the backing member 134 are inserted into the inner tubular section 120 around the coupling member 310, in this order. Finally, the cover member 136 is affixed to the top end of the lower unit 68 via the isolating member 138.

The coupling member 310 in this modified arrangement thus has a relatively long length without interfering with the bearing unit 124 and the seal members 137. The modified arrangement also increases the strength of connection of the upper and lower driveshaft sections 104, 106.

With continued reference to FIG. 6, the water pump 218 in this modified arrangement can have any constructions including conventional constructions. For instance, the boss 244 of the rotor 228 preferably is affixed to a tubular metal member 316 in a baking process. The rotor 228, together with the tubular metal member 316, is coupled with the upper driveshaft section 104 by a semicircular key 318 for rotation.

Figure 7:
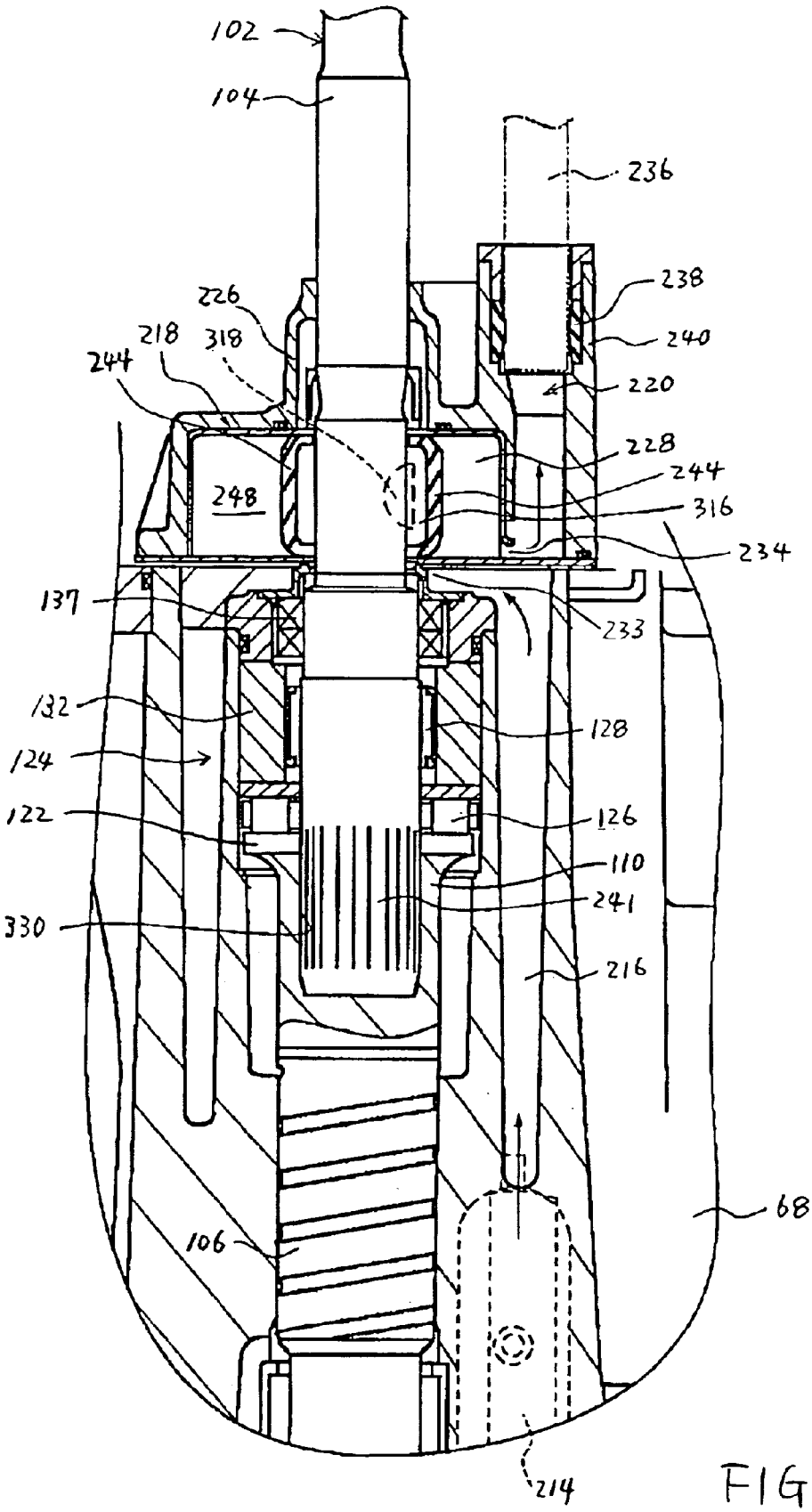

With reference to FIG. 7, the upper and lower driveshaft sections 104, 106 can be coupled with each other below the bearing unit 124. In the illustrated arrangement, the flange 122 is positioned atop the lower driveshaft section 106. A recess 330 is formed in the top end 110 of the lower driveshaft section 106. The recess 330 defines a plurality of key ways. The bottom end 241 of the upper driveshaft section 104, which is formed slightly thicker than the other part and has the key ways, is inserted into the recess 330 such that the key ways engage with one another.

No coupling member is used in this arrangement. Because the coupling of the driveshaft sections 104, 106 are made below the bearing unit 124, the recess 330 can have a relatively long length without interfering with the bearing unit 124. The modified arrangement of FIG. 7 also can increase the strength of connection of the upper and lower driveshaft sections 104, 106.

Figure 8:
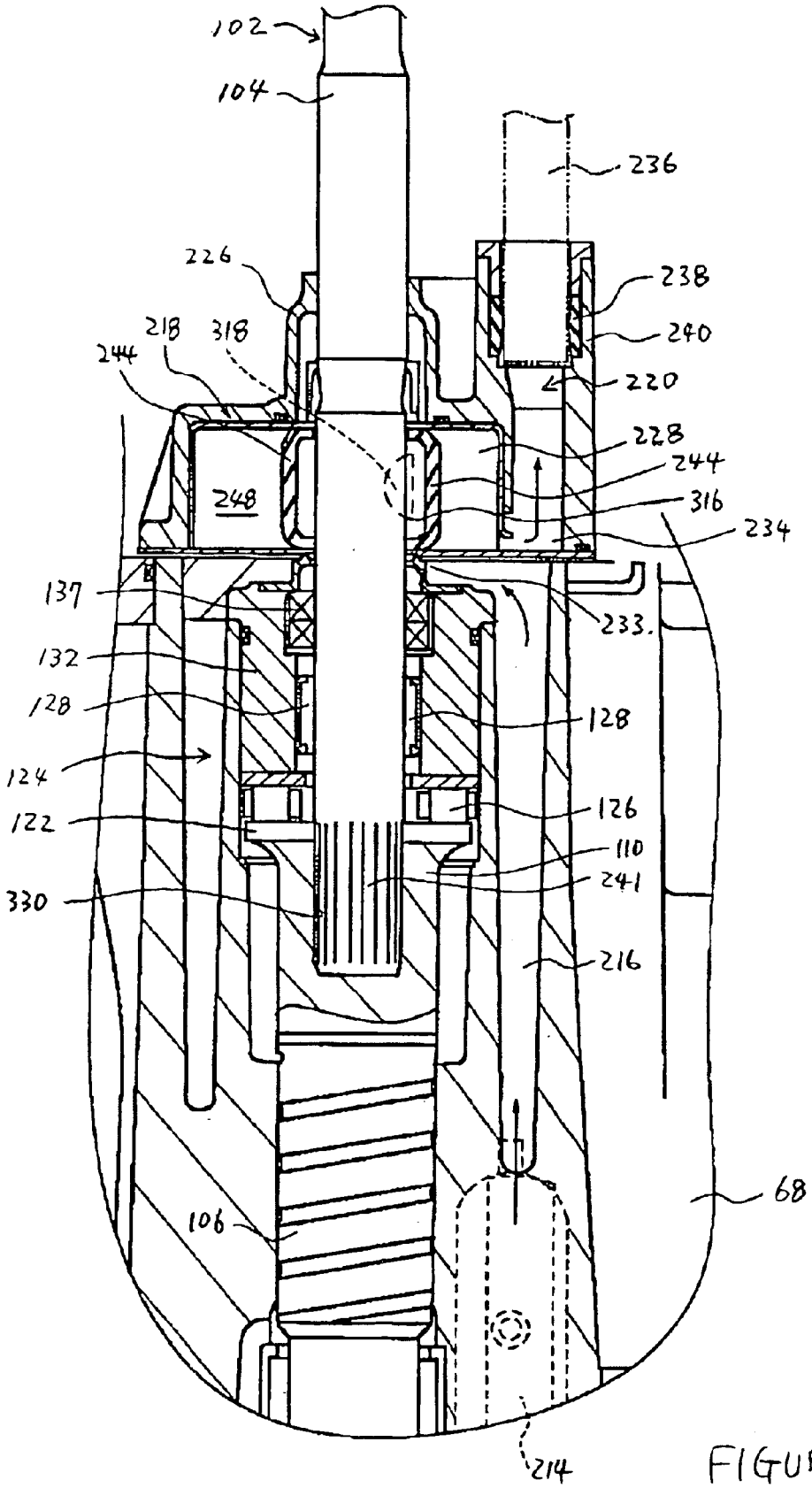

FIG. 8 illustrates an arrangement that is slightly modified from the arrangement of FIG. 7. In this arrangement, the upper driveshaft section 106 is generally straightly formed. Also, the foregoing backing member is unitarily formed with the ring member 132. The other components of this construction are the same as the arrangement of FIG. 7.

Figure 9:
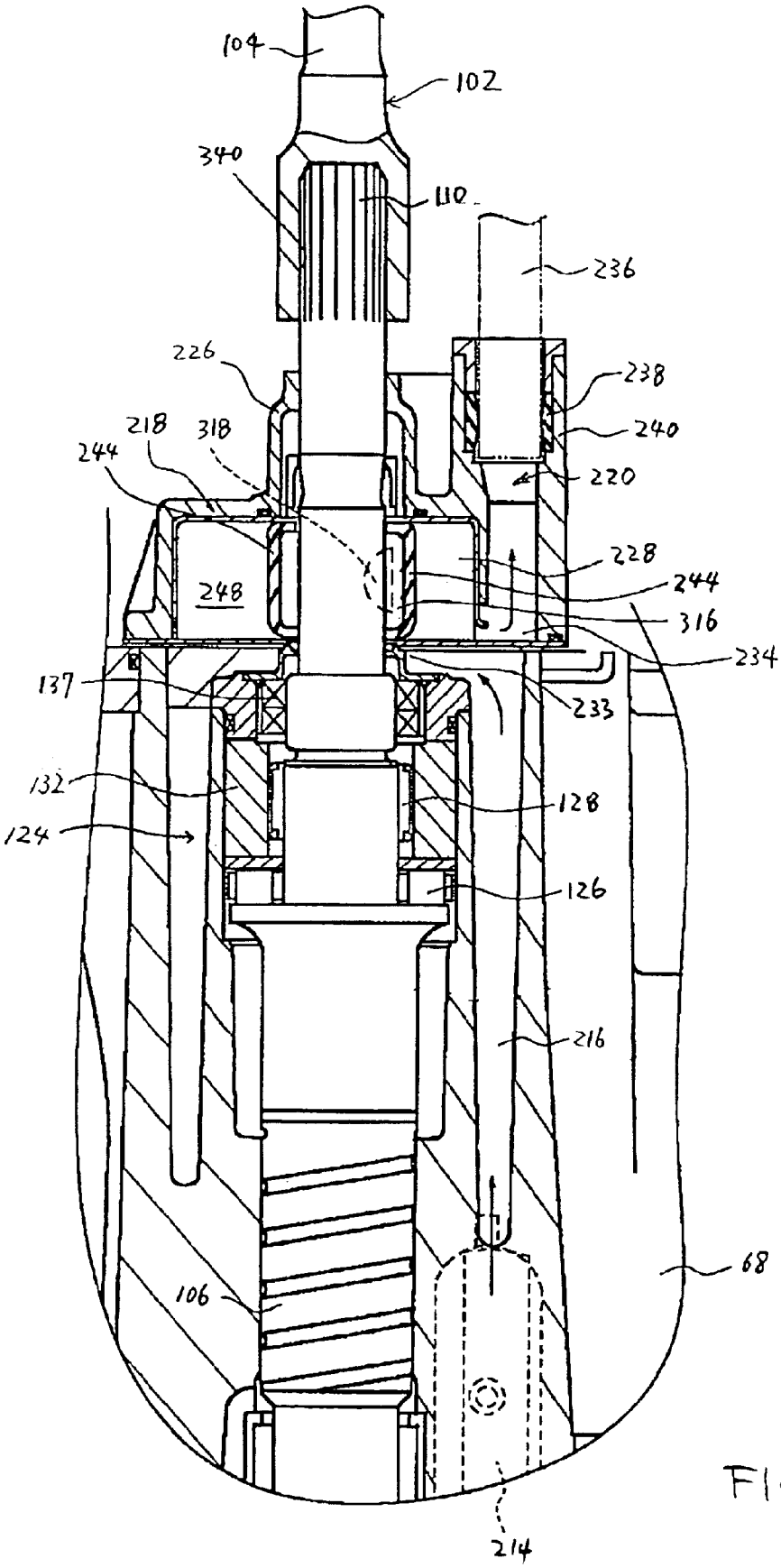

FIG. 9 illustrates another modified arrangement. The upper and lower driveshaft sections 104, 106 in this arrangement is coupled with each other above the water pump 218. The upper driveshaft section 104 has a recess 340 that defines a plurality of key ways. The key ways of the recess 340 engage the key ways of the top end 110 of the lower driveshaft section 106 such that the coupling of the sections 104, 106 is complete.

Figure 10:
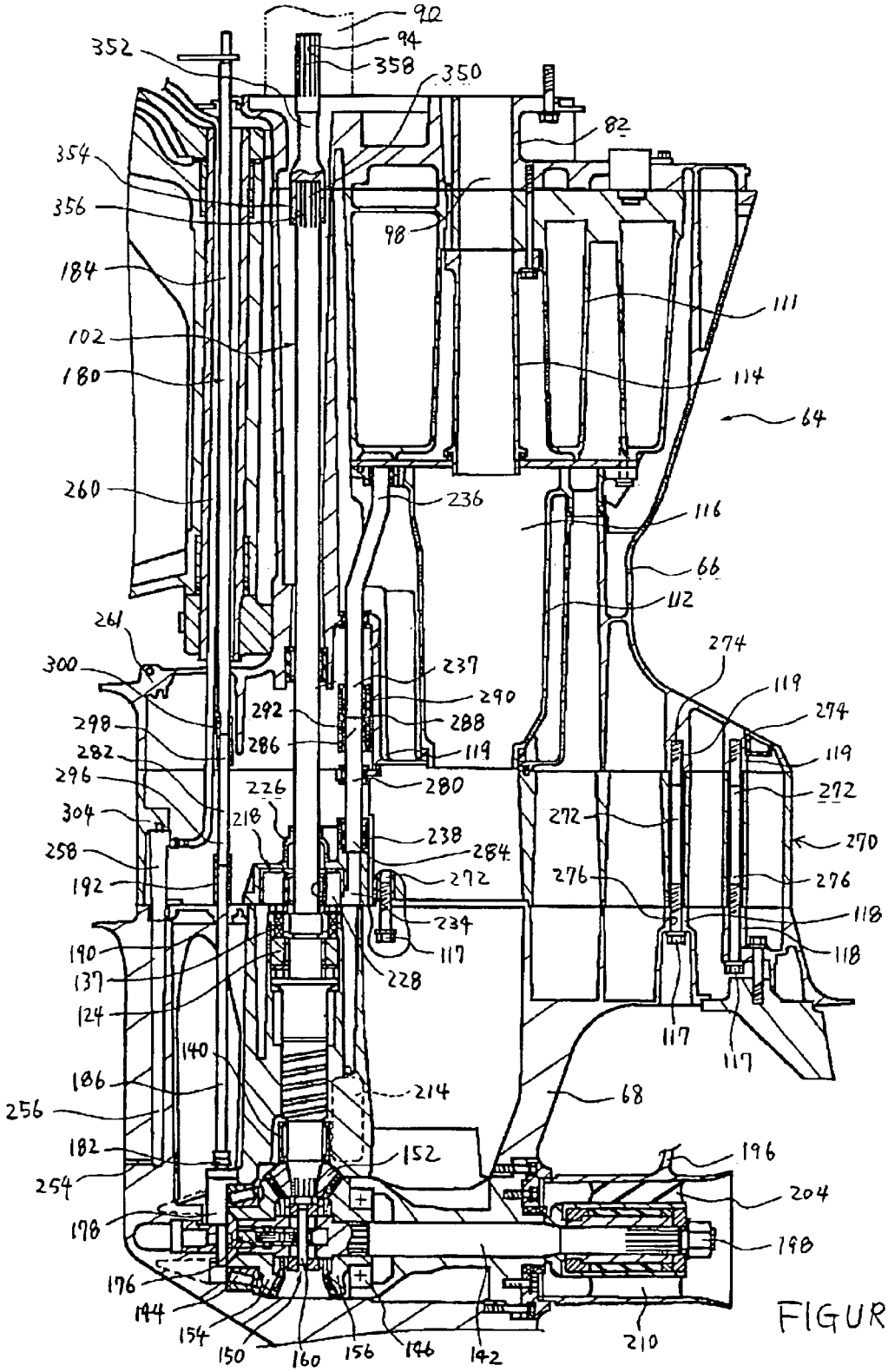

FIG. 10 illustrates a further modified arrangement. The driveshaft 102 is not divided into two sections in this arrangement. When the housing extension member 270 is not used, a top end 350 of the driveshaft 102 is coupled with the recess 94 of the crankshaft 90 through a spline connection. When the housing extension member 270 is used, the driveshaft 102 is shorter than a distance between the crankshaft 90 and the transmission. An extension shaft 352, therefore, is interposed between the crankshaft 90 and the driveshaft 102 to supplement the shaft length. A bottom end 354 of the extension shaft 352 has a recess 356 that defines a plurality of key ways. The top end 350 of the driveshaft 102 is inserted into the recess 356 such that the key ways engage with one another to complete the spline connection at the bottom end 354 of the extension shaft 352.

A top end 358 of the extension shaft 352 defines a plurality of key ways that can engage the key ways of the recess 94 of the crankshaft 90. The top end 358 is inserted into the recess 94 to complete the spline connection at the top end 358 of the extension shaft 352. The illustrated extension shaft 352 generally extends through the engine support member 82 and acts as an extended section of the driveshaft 102.

The extension shaft 352 can be conveniently used because a specific longer driveshaft is not necessary. The extension shaft 352 is short enough to be easily handled.

It should be noted that the water pump can be placed within the lower unit and the bearing unit can be placed within the driveshaft housing in some arrangements. Additionally, the spline connections in the embodiments described above can be of the straight type variety or of the type that allows for some axial misalignment between the shafts while still transferring torque from one shaft to the other (e.g., crown splines).

Although this invention has been disclosed in the context of certain preferred embodiments, variations and examples, it will be understood by those skilled in the art that the present invention extends beyond the specifically disclosed embodiments to other alternative embodiments and/or uses of the invention and obvious modifications and equivalents thereof. In particular, while the present shaft coupling has been described in the context of particularly preferred embodiments, the skilled artisan will appreciate, in view of the present disclosure, that certain advantages, features and aspects of the drive may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims that follow.

What is claimed is:

1. A marine propulsion device comprising first, second and third housings, the second housing being interposed between the first and third housings, a connector arranged to extend between the first and third housings and to couple the first, second and third housings with one another, a first shaft, at least a portion of the first shaft extending generally vertically through the first housing and extending into the second or third housing, a second shaft driven by the first shaft, at least a portion of the second shaft extending generally vertically through the third housing, the first shaft including a first plurality of external splines disposed at least near one of its ends, the second shaft including a second plurality of external splines disposed at least near one of its ends, a tubular coupling member defining a plurality of internal splines, the splines of the coupling member engaging the splines of the first and second shafts to couple together the first and second shafts, and a rotatable member driven by one of the first and second shafts, a majority of the rotatable member being generally positioned in the second or third housing, the coupling member being disposed between the rotatable member and said one of the first and second shafts.

2. The marine propulsion device as set forth in claim 1 additionally comprising a pump unit driven by either the first or second shaft, the pump unit being formed at least in part by the rotatable member.

3. The marine propulsion device as set forth in claim 2, wherein the rotatable member is a rotor that includes at least one vane.

4. The marine propulsion device as set forth in claim 2, wherein the coupling member and the rotor are firmly fixed with each other.

5. The marine propulsion device as set forth in claim 2, wherein the pump unit comprises a pump housing, and the coupling member is disposed substantially within the pump housing.

6. A marine propulsion device comprising at least first and second housings, a first shaft, at least a portion of the first shaft extending generally vertically through the first housing, a second shaft driven by the first shaft, at least a portion of the second shaft extending generally vertically through the second housing, the first shaft including a first plurality of external splines disposed at least near one of its ends, the second shaft including a second plurality of external splines disposed at least near one of its ends, a tubular coupling member defining a plurality of internal splines, the splines of the coupling member engaging the splines of the first and second shafts to couple together the first and second shafts, a rotatable member driven by one of the first and second shafts, the coupling member being disposed between the rotatable member and said one of the first and second shafts, and a bearing unit journaling either the first or second shaft, wherein the rotatable member is a bearing of the bearing unit.

7. A marine propulsion device comprising first second and third housings, the second housing being interposed between the first and third housings, a connector arranged to extend between the first and third housings and to couple the first, second and third housings with one another, a first shaft, at least a portion of the first shaft extending generally vertically through the first housing and extending into the second or third housing, a second shaft driven by the first shaft, at least a portion of the second shaft extending generally vertically through the third housing, either the first or second shaft defining a recess in the second or third housing, the second or first shaft that does not define the recess defining a tip portion that is inserted into the recess, the recess defining a first plurality of key ways on an inner surface thereof, the tip portion defining second plurality of key ways on an outer surface thereof, the respective first and second key ways being engaged with one another to couple together the first and second shafts.

8. The marine propulsion device as set forth in claim 7, wherein either the first or second housing incorporate a bearing unit journaling either the first or second shaft, and the recess receives the tip portion at a location external of the bearing unit.

9. The marine propulsion device as set forth in claim 7, wherein the tip portion has an outer diameter larger than another portion of the respective one of the first or second shaft.

10. The marine propulsion device as set forth in claim 7, additionally comprising a pump unit driven by one of the first and second shafts, and the recess receiving the tip portion at a location external of the pump unit.

11. A marine propulsion device comprising a prime mover having an output shaft extending generally vertically, first, second and third housings, the second housing disposed below the first housing, the third housing disposed below the second housing, a first shaft driven by the output shaft, at least a portion of the first shaft extending generally vertically within the first housing, and a second shaft driven by the first shaft, at least a portion of the second shaft extending generally vertically through the first, second and third housings, the output shaft and the first shaft being coupled together by a first spline coupling, and the first and second shafts being coupled together by a second spline coupling.

12. The marine propulsion device as set forth in claim 11, wherein the second spline coupling includes a first recess at a bottom end of the first shaft and a first tip portion at a top end of the second shaft, the first tip portion being inserted into the first recess, the first recess defining first key ways on an inner surface thereof, the first tip portion defining second key ways on an outer surface thereof, the respective first and second key ways being engaged with one another to couple together the first and second shafts.

13. The marine propulsion device as set forth in claim 11, wherein the first spline coupling includes a first recess at a bottom end of the output shaft and a first tip portion at a top end of the first shaft, the first tip portion being inserted into the first recess, the first recess defining first key ways on an inner surface thereof, the first tip portion defining second key ways on an outer surface thereof, the respective first and second key ways being engaged with one another to couple together the output shaft and the first shaft.

14. The marine propulsion device as set forth in claim 13, wherein the second spline coupling includes a second recess at a bottom end of the first shaft and a second tip portion at a top end of the second shaft that is inserted into the second recess, the second recess defining third key ways on an inner surface thereof, the second tip portion defining fourth key ways on an outer surface thereof, the respective third and fourth key ways being engaged with one another to couple together the first and second shafts.

15. The marine propulsion device as set forth in claim 14, wherein the first housing defines a support portion that supports the prime mover above the rest of the first housing, and the first shaft extends at least substantially through the support portion.

16. The marine propulsion device as set forth in claim 15, wherein the fourth key ways are capable of engaging the first key ways.

17. A marine propulsion device comprising first, second and third housings, the second housing being interposed between the first and third housing, a first shaft, at least a portion of the first shaft extending generally vertically through the first housing and extending into the second housing, a second shaft driven by the first shaft, at least a portion of the second shaft extending generally vertically in the third housing and extending into the second housing, and a pump unit driven by either the first or second shaft, the pump unit comprising a pump housing surrounding the first or second shaft, the pump housing being positioned in the second housing, the first and second shafts being coupled together within the pump housing.

18. The marine propulsion device as set forth in claim 17 additionally comprising a coupling member that couples together the first and second shafts.

19. The marine propulsion device as set forth in claim 18, wherein the pump unit additionally comprises a rotor that is affixed to the coupling member.

20. The marine propulsion device as set forth in claim 19, wherein the coupling member is tubular to define a hollow, the first and second shafts are coupled within the hollow, and the rotor is affixed to an outer surface of the coupling member.

21. The marine propulsion device as set forth in claim 18, wherein the coupling member is tubular, the first shaft defines first key ways on an outer end surface, the second shaft defines second key ways on an outer end surface, the coupling member defines third key ways on an inner surface thereof, the coupling member is joined with the end of the first shaft and the end of the second shaft by the respective key ways.

22. A marine propulsion device comprising first, second and third housings, the second housing being interposed between the first and third housings, a first shaft, at least a portion of the first shaft extending generally vertically through the first and second housings and extending into the third housing, a second shaft driven by the first shaft, at least a portion of the second shaft extending generally vertically in the third housing, a coupling member joining the first and second shafts together, and a bearing unit journaling the coupling member substantially in the third housing.

23. The marine propulsion device as set forth in claim 22, wherein the bearing unit comprises a radial bearing, and the coupling member is journaled by the radial bearing.

24. The marine propulsion device as set forth in claim 2, wherein the pump unit at least in part is positioned in the second housing.

25. The marine propulsion device as set forth in claim 6, wherein the bearing unit at least in part is positioned in the second housing.

26. The marine propulsion device as set forth in claim 7, wherein the first shaft extends into the third housing, the recess is positioned in the third housing.

27. The marine propulsion device as set forth in claim 17 additionally comprising a conduit connected to the pump housing, the conduit comprising at least first and second portions, the first portion extending in the first housing, the second portion extending in the first and second housings.

28. The marine propulsion device as set forth in claim 17 additionally comprising a connector arranged to extend between the first and third housings and to couple the first, second and third housings with one another.

* * * * *